US006094786A

United States Patent [19]

Wakabayashi

[11] Patent Number: 6,094,786

[45] Date of Patent: Aug. 1, 2000

[54] SLIDE FASTENER SLIDER AND MOLD FOR DIE-CASTING THE SAME

[75] Inventor: Masao Wakabayashi, Toyama-ken, Japan

[73] Assignee: YKK Corporation, Tokyo, Japan

[21] Appl. No.: 09/157,154

[22] Filed: Sep. 18, 1998

[30] Foreign Application Priority Data

Sep. 19, 1997 [JP] Japan ..... 9-254909

[51] Int. Cl.[7] ..... A44B 19/00

[52] U.S. Cl. ..... 24/429; 24/419; 24/437

[58] Field of Search ..... 24/429, 419, 437, 24/370, 387

[56] References Cited

U.S. PATENT DOCUMENTS

| | | | |
|---|---|---|---|
| 2,615,225 | 10/1952 | Epple . | |
| 2,835,011 | 5/1958 | Malcolm | 24/419 |
| 3,320,645 | 5/1967 | Burbank | 24/421 |
| 4,624,032 | 11/1986 | Ishii et al. | 24/429 |
| 4,780,938 | 11/1988 | Ishii | 24/429 |
| 4,823,447 | 4/1989 | Akashi | 24/421 |
| 5,105,512 | 4/1992 | Aussedat | 24/419 |

FOREIGN PATENT DOCUMENTS

| | | | |
|---|---|---|---|
| 0 850 577 | 1/1998 | European Pat. Off. . | |
| 199 170 | 8/1938 | Switzerland . | |
| 0669587 | 4/1952 | United Kingdom | 24/421 |

*Primary Examiner*—Victor N. Sakran
*Attorney, Agent, or Firm*—Hill & Simpson

[57] ABSTRACT

In a die-casting slide fastener slider having a plastically deformable, cantilevered pull-tab attaching lug on a slider body, the lug projects from an upper end of a guide post over an upper wing toward a rear end of the upper wing and terminates in a downward end projection spaced from the upper wing by a gap through which an attachment ring of a pull tab is threaded. The lug has a longitudinal hollow through its base to facilitate plastically deforming the lug to reduce the size of the gap after threading. In this structure, since first and second slide cores of a mold for die-casting the slide fastener slider can be inserted from the front and rear sides, it is possible to mold the lug without generating any parting line on its overall appearance.

11 Claims, 7 Drawing Sheets

SLIDE FASTENER SLIDER AND MOLD FOR DIE-CASTING THE SAME

BACKGROUND OF THE INVENTION

1. Field of the Invention

The present invention relates to a slide fastener slider manufactured by molding a cantilevered pull-tab attaching lug on a slider body by die-casting using metal, then threading an attachment ring of a pull tab onto the pull-tab attaching lug from its free end and finally plastically deforming the pull-tab attaching lug by pressing. The invention relates also to a mold for die-casting such slider.

2. Description of the Related Art

In slide fastener sliders of the described type, it has been a common practice to provide a cantilevered pull-tab attaching lug on a front end of an upper wing of the slider body so as to leave a gap between its rear or free end and the upper wing, then to thread the attachment ring of the pull tab onto the pull-tab attaching lug via the gap and finally to plastically deform the pull-tab attaching lug by pressing to reduce the size of the gap to prevent accidental removal of the attached pull tab.

Japanese Utility Model Publication No. Hei 2-12889 discloses a die-casting mold for slide fastener slider, comprising an upper die of lateral-split type for molding the upper half part of the upper wing and the cantilevered pull-tab attaching lug, a lower die of lateral-split type for molding the exteriors of lower half part of the lower wing, a first slide core disposed between the upper and lower dies and longitudinally slidable to enter the slider body from its front end for molding the front part of the guide post and the interiors of a guide channel and of guide flanges, and a second slide core engageable with the first slide core and longitudinally slidable to enter the slider body from its rear end for molding the rear part of the guide post and exteriors of the guide channel and of the guide flanges.

According to the above-mentioned conventional slider, when the pull-tab attaching lug is pressed on its top surface to plastically deform its base after the pull tab is mounted onto the pull-tab attaching lug, a great pressing force is required so that the base would tend to be cracked or otherwise damaged. Besides, the slider body inevitably has parting lines on the longitudinal, central portions of the slider, including the pull-tab attaching lug, making the overall appearance of the slider body unsightly.

According to the above-mentioned conventional die-casting mold, since the upper and lower dies for molding the slider body are parted laterally in opposite directions, parting lines would occur longitudinally and centrally on and along the slider body itself and the pull-tab attaching lug as well, making the overall appearance of the slider unsightly. Further, with this conventional mold, it is difficult to manufacture such a slider that the pull-tab attaching lug can be plastically deformed easily by pressing.

SUMMARY OF THE INVENTION

It is therefore a first object of the present invention to provide a slide fastener slider which is suitable to be molded by die-casting, in which a pull tab can easily be attached to a cantilevered pull-tab attaching lug standing on a slider body, and which is devoid of any parting line due to molding process on surfaces centrally of the slider body including the pull-tab attaching lug to secure a tidy appearance.

A second object of the invention is to provide a slide fastener slider in which the pull-tab attaching lug can be plastically deformed with ease to facilitate attaching the pull tab to the pull-tab attaching lug and which is neat in appearance.

A third object of the invention is to provide a slide fastener slider in which an attachment ring of the pull tab can be threaded onto the pull-tab attaching lug smoothly from a free end of the pull-tab attaching lug and is prevented from being accidentally removed off the pull-tab attaching lug once it is mounted.

A fourth object of the invention is to provide a slide fastener slider in which the pull-tab attaching lug is good in balance and neat in appearance and can be threaded through the attachment ring of the pull tab smoothly.

A fifth object of the invention is to provide a slide fastener slider in which parting lines due to die-casting are concealed and a slider body is finished in a unique design.

A sixth object of the invention is to provide a slide fastener slider in which the pull tab can be attached to the pull-tab attaching lug of the slider body in a simple manner using simple means to complete the assembling of the slider.

A seventh object of the invention is to provide a mold for die-casting a slide fastener slider which mold can die-cast a slide body without making any apparent parting line on its surfaces and which mold is suitable for molding a slider such that a pull-tab attaching lug can be plastically deformed easily using simple means, facilitating attaching a pull tab to the pull-tab attaching lug and preventing the attached pull tab from being accidentally removed off the lug.

An eighth object of the invention is to provide a mold for die-casting the slide fastener slider which mold includes slide cores capable of molding the slider body simply without any parting line on the surfaces of the pull-tab attaching lug.

A ninth object of the invention is to provide a mold for die-casting the slide fastener slider which mold includes slide cores capable of molding the slider body such that an attachment ring of the pull tab can be threaded onto the pull-tab attaching lug with ease.

A tenth object of the invention is to provide a mold for die-casting the slide fastener slider which mold can mold the slider body easily in a unique design, enabling to conceal parting line on an upper surface of a slider body.

In order to accomplish the above first object, according to a first aspect of the present invention, a slide fastener slider comprises: a die-cast slider body composed of upper and lower wings connected at their front ends by a guide post; a cantilevered i.e. inverted L-shaped pull-tab attaching lug projecting from an upper surface of the guide post toward an rear end of the slider body on the upper wing with a gap being formed by an opening at the rear end side of the pull-tab attaching lug, the pull-tab attaching lug having a hollow extending longitudinally through its base and an end projection extending from an end i.e. at the lower surface on the rear end side of the pull-tab attaching lug toward and terminating short of an upper surface of the upper wing, the downwardly projecting end projection having a width substantially equal to a width of the hollow and being spaced a gap from the upper wing so that a pull tab having a attachment ring can be threaded on the pull-tab attaching lug.

According to a second aspect of the invention, the above second object is accomplished by that the hollow extending through the base of the pull-tab attaching lug has a right-angled hexahedral contour and has a pair of vertical flat side walls.

According to a third aspect of the invention, the above second object is accomplished alternatively by that the hollow extending through the base of the pull-tab attaching lug extends from the base to a base of the end projection projecting from a lower surface of a distal end of the pull-tab attaching lug.

According to a fourth aspect of the invention, the above third object is accomplished by that the gap between the upper wing and the end projection of the pull-tab attaching lug has a size substantially equal to the thickness of the attachment ring of the pull tab before the attachment ring of the pull tab is threaded on the pull-tab attaching lug.

According to a fifth aspect of the invention, the above third object is accomplished alternatively by that the upper wing has in its upper surface a recess extending from the rear end forwardly in a range beyond a position underneath the end projection, the recess having an arcuate transverse cross section and a width larger than the width of the end projection.

According to a sixth aspect of the invention, the above third object is accomplished in another alternative form by that the recess formed in the upper wing of arcuate cross section has a contour substantially complementary to a part of a contour of the outer surface of the attachment ring of the pull tab.

According to a seventh aspect of the invention, the above fourth object is accomplished by that the pull-tab attaching lug are tapered, as viewed in plan view, with its width decreasing gradually from an upper end of the base toward the rear end.

According to an eighth aspect of the invention, the above fifth object is accomplished by that the upper wing has on its upper surface at opposite sides of the base of the pull-tab attaching lug a central platform bulging centrally of the slider body and extending longitudinally between the front and rear ends of the slider body.

According to a ninth aspect of the invention, the above sixth object is accomplished by that the pull tab is attached to the pull-tab attaching lug by threading the attachment ring onto the pull-tab attaching lug via the gap between the upper wing and the end projection provided in the pull-tab attaching lug and then plastically deforming the pull-tab attaching lug by pressing so as to reduce the size of the gap to prevent removal.

According to a tenth aspect of the invention, the above seventh object is accomplished by a mold for die-casting a slide fastener slider, which includes a die-casting slider body composed of upper and lower wings connected at their front ends by a guide post, and a cantilevered pull-tab attaching lug projecting from an upper surface of the guide post toward an rear end of the upper wing, the pull-tab attaching lug having a hollow extending longitudinally through its base and an end projection extending from a rear end of the pull-tab attaching lug extending toward and terminating short of an upper surface of the upper wing, the end projection having a width substantially equal to a width of the hollow and being spaced a gap from the upper wing, the mold comprising: an upper die having a first cavity for forming an upper surface of the upper wing of the slider body; a lower die having a second cavity for forming a lower surface of the lower wing, the lower die being relatively movable toward and away from the upper die; a plug-shaped first slide core slidably disposed between the upper and lower dies for forming the hollow, which extends through the base of the pull-tab attaching lug, and a front and side walls of the base of the pull-tab attaching lug; a recess-shaped slide core relatively slidable toward and away from the plug-shaped first slide core for forming the end projection of the pull-tab attaching lug and a lower surface of the pull-tab attaching lug; a recess-shaped third slide core frictionally engageable with the first and second slide cores and the upper die and slidable on the lower die for forming a front part of the guide post, a guide groove and interiors of guide flanges; and a plug-shaped fourth slide core slidable toward and away from with the third slide core for forming a rear part of the guide post, the guide groove and exteriors of the guide flanges.

According to an eleventh aspect of the invention, the above eighth object is accomplished by that the first slide core has a first core body, a long, central projection extending centrally from one end of the first core body for forming the hollow, and a pair of short, side projections extending from one end of the first core body and spaced laterally at opposite sides of the central projection for forming the parallel side walls, and the second slide core has a second core body, a pair of inverted D-shaped protuberances on opposite sides of the second core body for slidably engageable with the central projections provided in the first slide core to form the lower surface of the pull-tab attaching lug, and a stepped cutout formed at a common base of the protuberances and engageable with the central projection for forming the end projection on the lower end surface of the pull-tab attaching lug.

According to a twelfth aspect of the invention, the above ninth object is accomplished by that the second slide core has longitudinally on its lower surface a central ledge having an arcuate transverse cross section and a width substantially equal to the width of the pull-tab attaching lug and extending to an intermediate position of the lower surface of the protuberances, a distal end of the central ledge being adapted to be disposed underneath and in contact with a lower surface of the central projection of the first slide core.

According to a thirteenth aspect of the invention, the above tenth object is accomplished by that the upper die has in a surface of the cavity a groove for slidably receiving the first and second slide cores in such a manner that a lower common surface of the first and second slide cores are upwardly offset from a lower surface of the upper die for forming a stepped platform on the upper wing of the slider body at the opposite sides of the pull-tab attaching lug.

DETAILED DESCRIPTION OF THE PREFERRED EMBODIMENTS

The principle of the present invention are particularly useful when applied to a die-casting slide fastener slider and a mold for die-casting a slide fastener slider, several preferred embodiments of which will now be described in detail with reference to the accompanying drawings.

Figure 1:
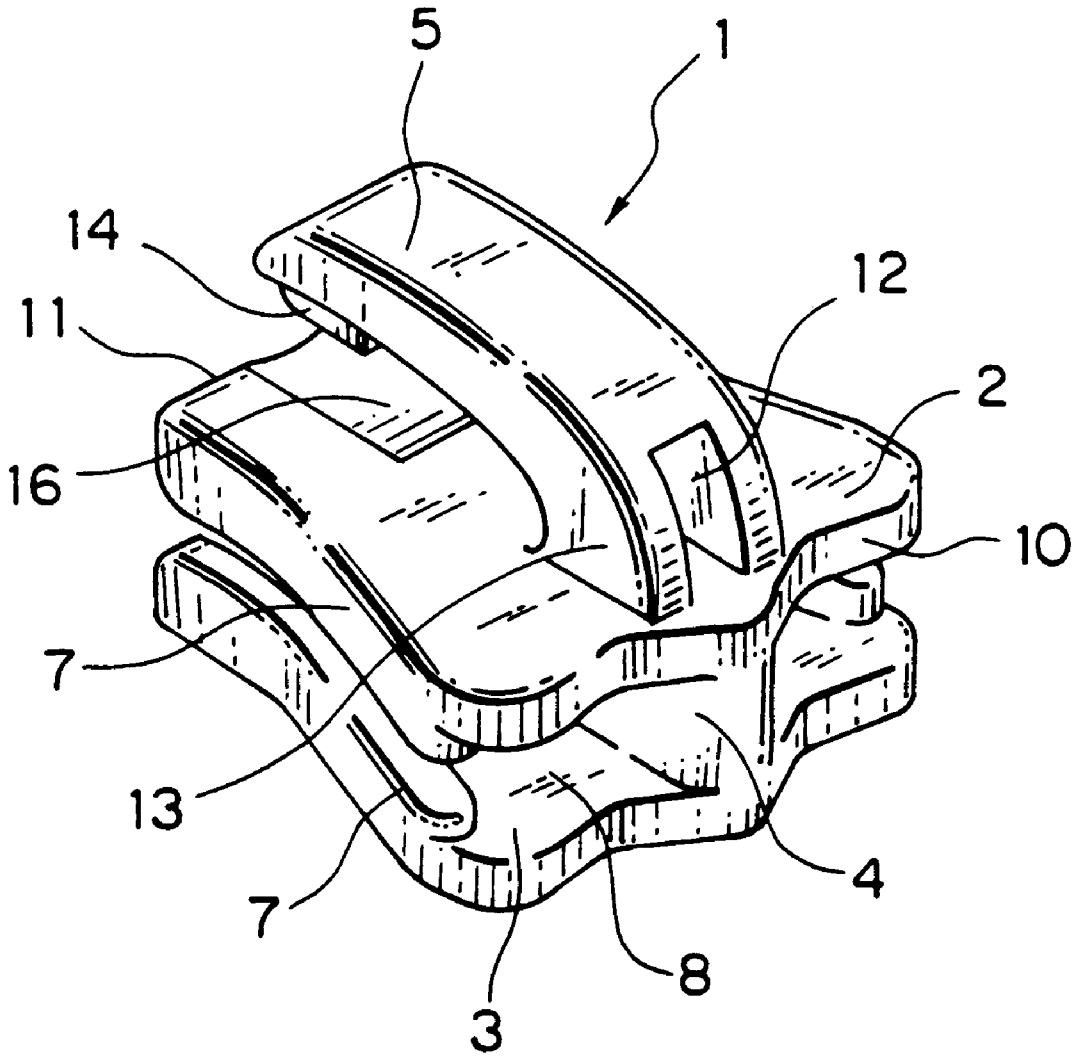
FIG. 1 is a perspective view of a slider body of a slide fastener slider of the type in which a pull tab is to be attached to the slider body after the slider body has been molded by die-casting, according to a first embodiment of the present invention.
Figure 2:
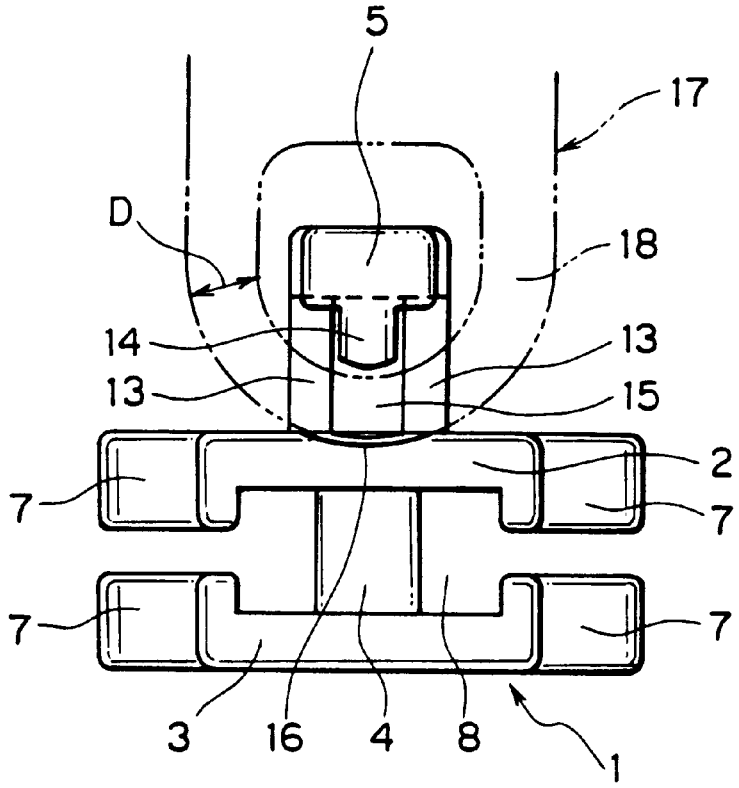
FIG. 2 is a rear view of the slider body of the first embodiment.
Figure 3:
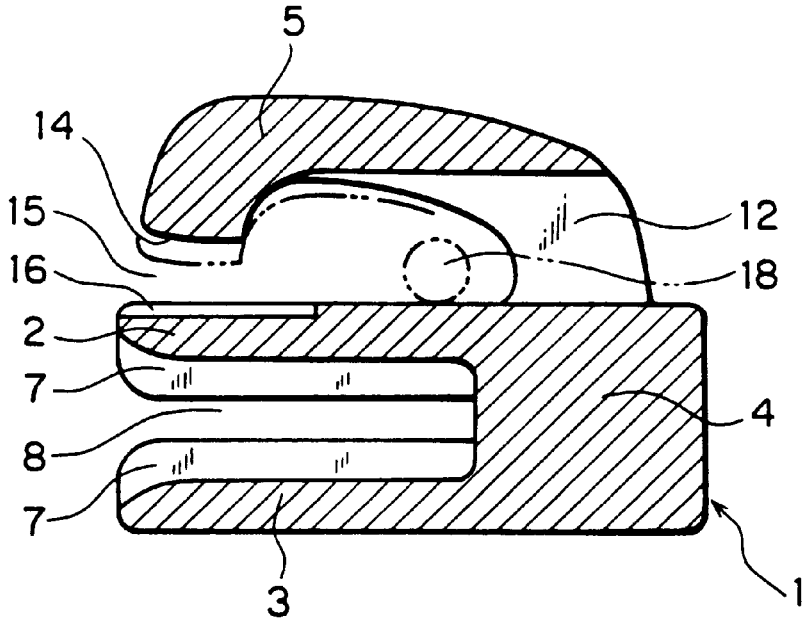
FIG. 3 is a longitudinal cross-sectional view of the slider body of the first embodiment.

As shown in FIGS. 1 through 3, in a slide fastener slider of the type in which a pull tab 17 is to be attached to a slider body 1 after the slider body 1 has been molded, the slider body 1 is molded of metal such as aluminum alloy or zinc alloy by die-casting and is composed of upper and lower wings 2, 3 connected at their front ends 10 by a guide post, and a cantilevered, namely, inverted L-shaped pull-tab attaching lug 5 stands on the upper surface of the upper wing 2 and projects from the upper surface of the guide post 4 toward a rear end 11 of the upper wing 2.

The upper and lower wings 2, 3 have along their respective side edges a pair of downwardly bent upper guide flanges 7, 7 and a pair of upwardly bent lower guide flanges 7, 7, defining between the upper and lower wings 2, 3 a Y-shaped guide channel 8 for guiding a pair of rows of fastener elements. The upper guide flanges 7 or the lower guide flanges 7 may be omitted, depending on the type of fastener elements.

The pull-tab attaching lug 5 projecting on the slider body 1 over the upper wing 2 has a right-angled hexahedral hollow 12 extending longitudinally through its base and projecting from the upper end of the guide post 4 and terminates in a downwardly directed rear or free end. As shown in FIG. 2, an end projection 14 extends from the free end of the pull-tab attaching lug 5 i.e. in a lower surface toward the rear end 11 of the slider body 1 and terminates short of the upper surface of the upper wing 2, having a width substantially equal to the hollow 12.

The hollow 12 extends from the base of the pull-tab attaching lug 5 to a base of the end projection 14, as shown in FIG. 3, having a varying width gradually decreasing along the lower surface of the pull-tab attaching lug 5 in a form of a recess. The upper wing 2 has in its upper surface a recess 16 extending from the rear end 11 forwardly beyond a position underneath an inner edge of the end projection 14 and having an arcuate transverse cross section, as viewed from the rear side of the upper wing 2, such that the distance between the inner edge of the end projection 14 and an inner end of the recess 16 is at least slightly larger than the radial thickness D (FIG. 2) of an attachment ring 18 of the pull tab 17.

The recess 16 has a contour substantially complementary to a part of the contour of an outer surface of the attachment ring 18 of the pull tab 17. A gap 15 defined between the end projection 14 and the bottom of the recess 16 is equal to or slightly larger than the radial thickness D of the attachment ring 18 of the pull tab 17 so that the attachment ring 18 can pass freely. Once the attachment ring 18 has passed the gap 15 with the pull tab 17 assuming an upright posture, it is difficult to remove the pull tab 17 off the pull-tab attaching lug 5 as long as the pull tab 17 assumes a horizontal posture, because the gap 15 between the end projection 14 and the upper surface of the upper wing 2 is smaller than the thickness of the attachment ring 18 irrespective of the presence of the recess 16. Therefore, after the attachment ring 18 has been threaded onto the pull-tab attaching lug 5, when the pull-tab attaching lug 5 is pressed downwardly toward the upper wing 2 to plastically deform to reduce the size of the gap 15, the pull tab 17 can no longer be removed off the pull-tab attaching lug 5.

Alternatively the recess 16 may be omitted, namely, the upper surface of the upper wing 2 may be flat as long as the gap 15 between the upper surface of the upper wing 2 and the end projection 14 is substantially equal to and slightly larger than the radial thickness D of the attachment ring 18 of the pull tab 17.

Figure 4:
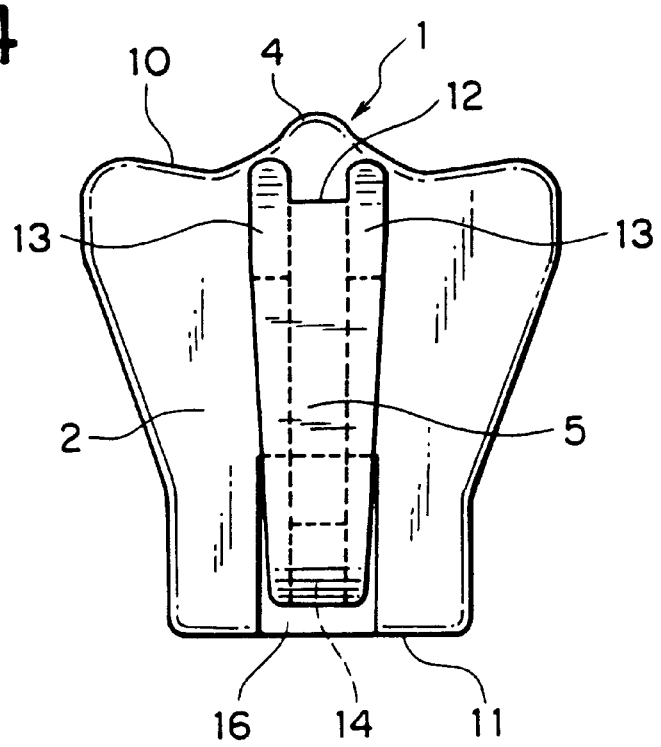
FIG. 4 is a top plan view of a slider body according to a second embodiment of the invention.

FIG. 4 shows a modified slider body 1 according to a second embodiment of the present invention. In this modified slider body 1, the cantilevered pull-tab attaching lug 5 standing on the upper surface of the upper wing 2 is tapered from the upper portion of its base toward the rear end near the rear end 11 of the upper wing 2, as viewed in plan, facilitating threading the attaching ring 18 of the pull tab 17 onto the pull-tab attaching lug 5.

Figure 5:
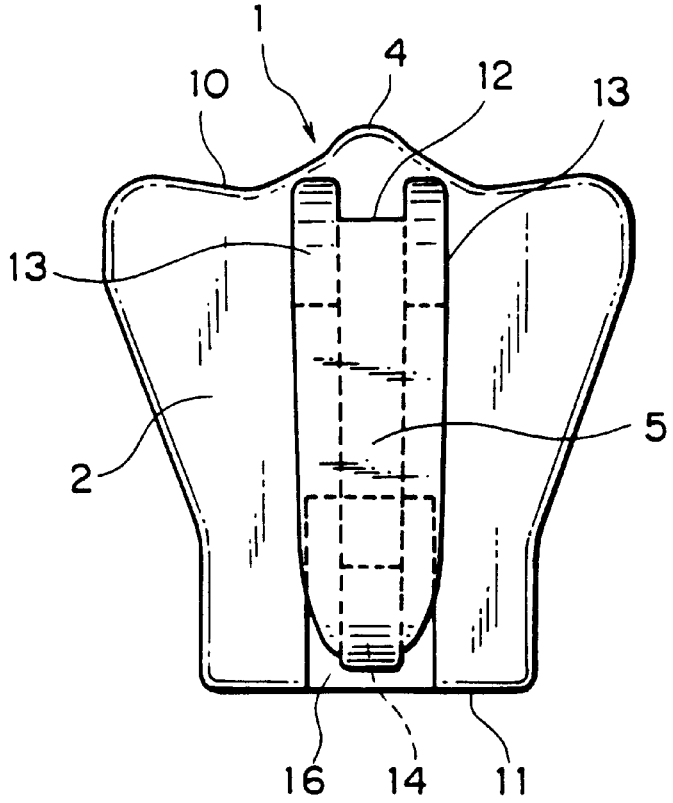
FIG. 5 is a top plan view of a slider body according to a third embodiment of the invention.

FIG. 5 shows another modified slider body 1 according to a third embodiment. In this embodiment, the cantilevered pull-tab attaching lug 5 standing on the upper surface of the upper wing 2 has a uniform width except that its rear end near the rear end 11 of the upper wing 2 is rounded, as viewed in plan, to prevent the attachment ring 18 from jamming between the rear end portion of the pull-tab attaching lug 5 and the upper wing 2, facilitating operating the pull tab 17.

Figure 6:
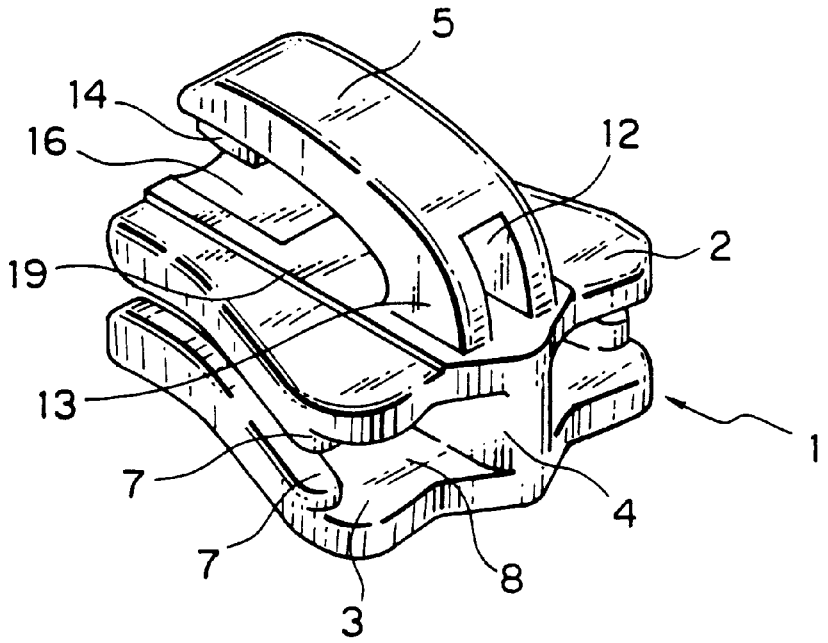
FIG. 6 is a perspective view of a slider body according to a fourth embodiment of the invention.
Figure 7:
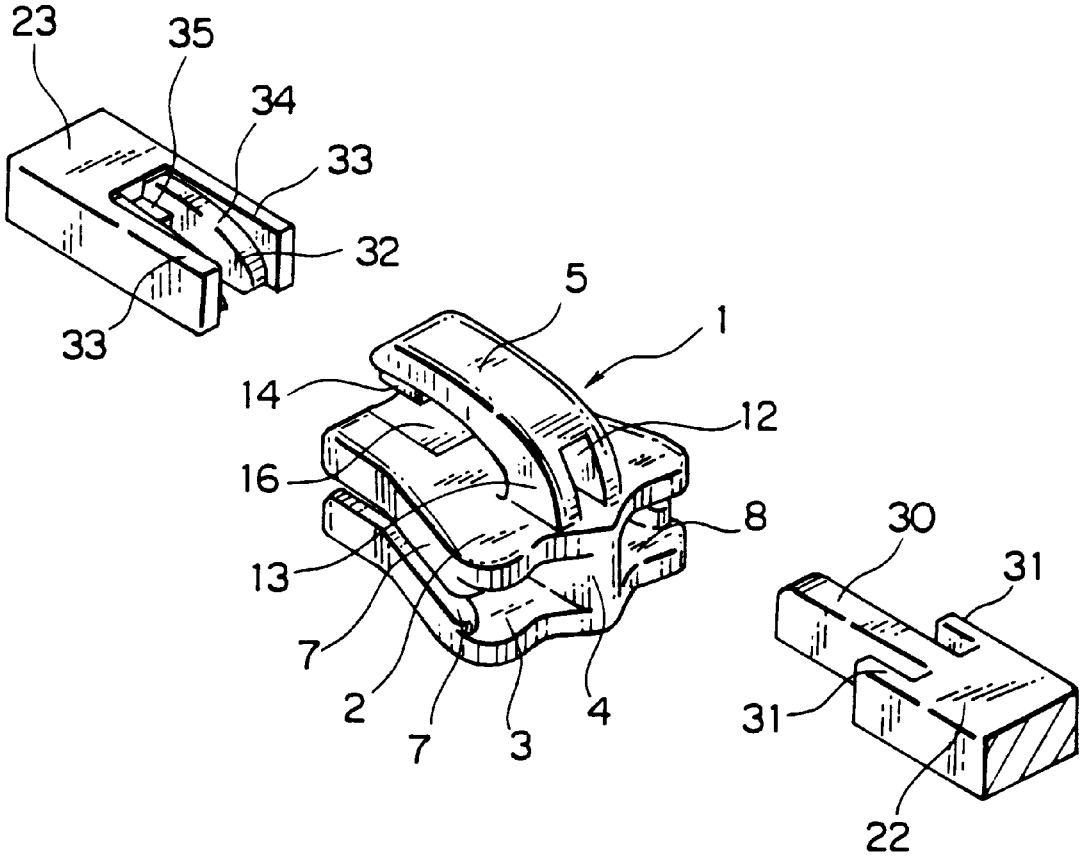
FIG. 7 is a exploded perspective view of slide cores for molding a pull-tab attaching lug of the slide fastener slider.

FIG. 6 shows still another modified slider body 1 according to a fourth embodiment. This embodiment is differentiated over the foregoing embodiments that the upper wing 2 has on its upper surface a central platform 19 extending longitudinally between the front and rear ends 10, 11 of the slider body 1 and over opposite sides of the base of the pull-tab attaching lug 5. With this platform 19, if the setup of the die-casting mold is such that possible parting lines are aligned with the ridges of the platform 19, it is possible to make the parting lines not eye-catching but neat in appearance.

Figure 8:
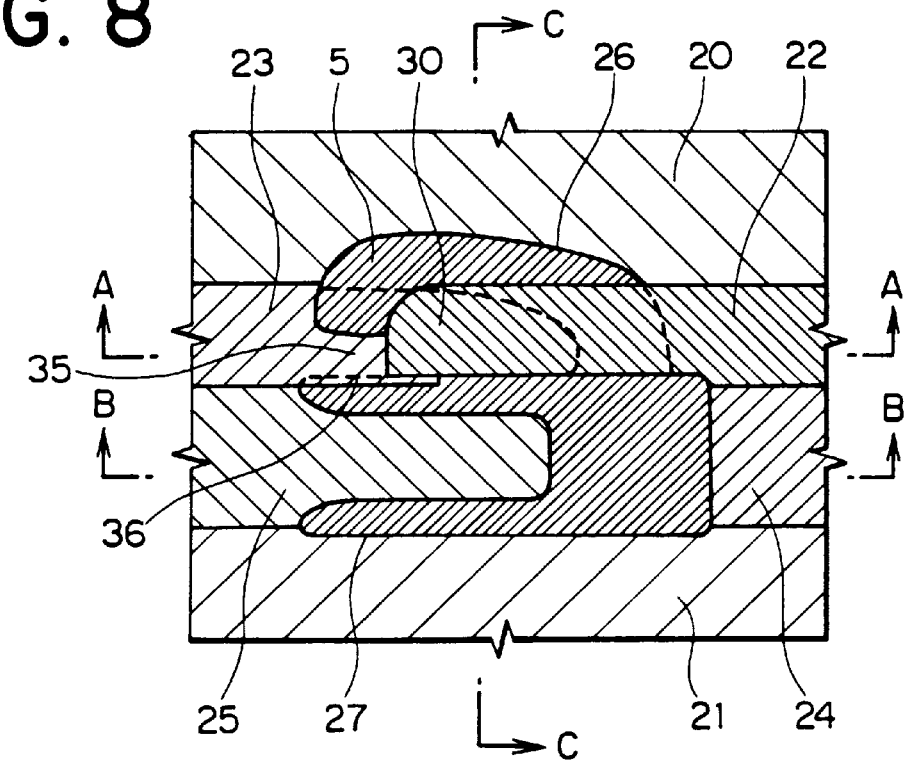
FIG. 8 is a longitudinal cross-sectional view of a mold for die-casting a slide fastener slider.

The mold for die-casting the foregoing slide fastener slider will now be described with reference to FIGS. 7 through 11. Firstly as shown in FIGS. 8 and 11, the mold includes upper and lower dies 20, 21 vertically engageable with each other for molding the upper and lower surfaces of the slider body 1, a mutually cooperating set of first and second slide cores 22, 23 (described below), and a mutually cooperative set of third and fourth slide cores 24, 25 adapted to be longitudinally slidably located along the contact surface of the upper and lower dies 20, 21 for molding the guide post 4 of the slider body 1 and the guide flanges 7 (i.e., the guide channel 8).

Figure 9:
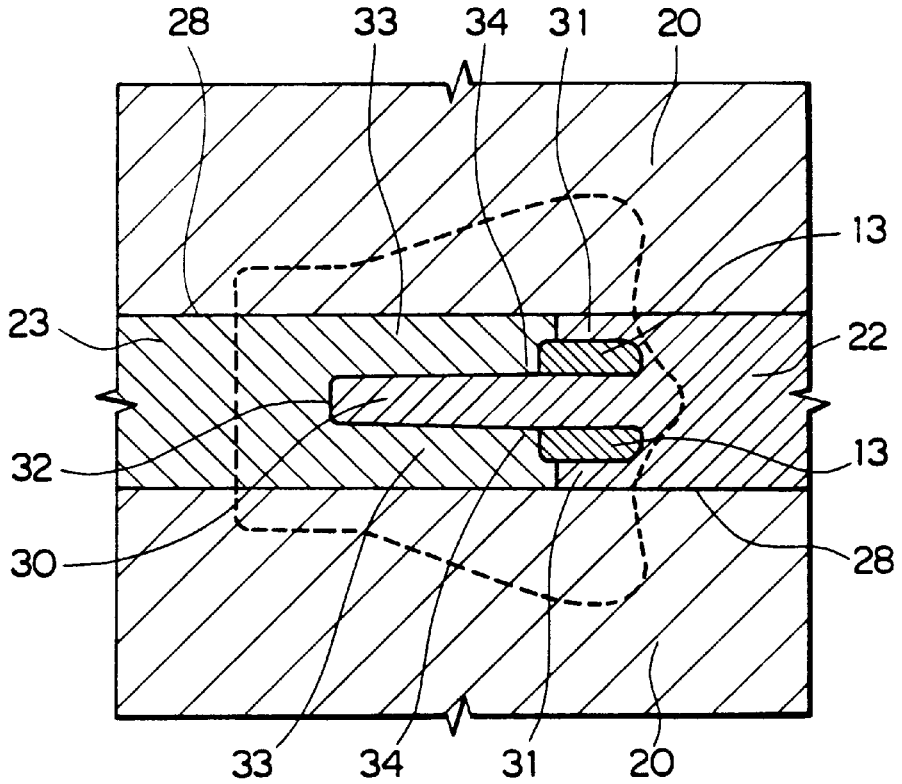
FIG. 9 is a cross-sectional view taken along line A—A of FIG. 8.
Figure 10:
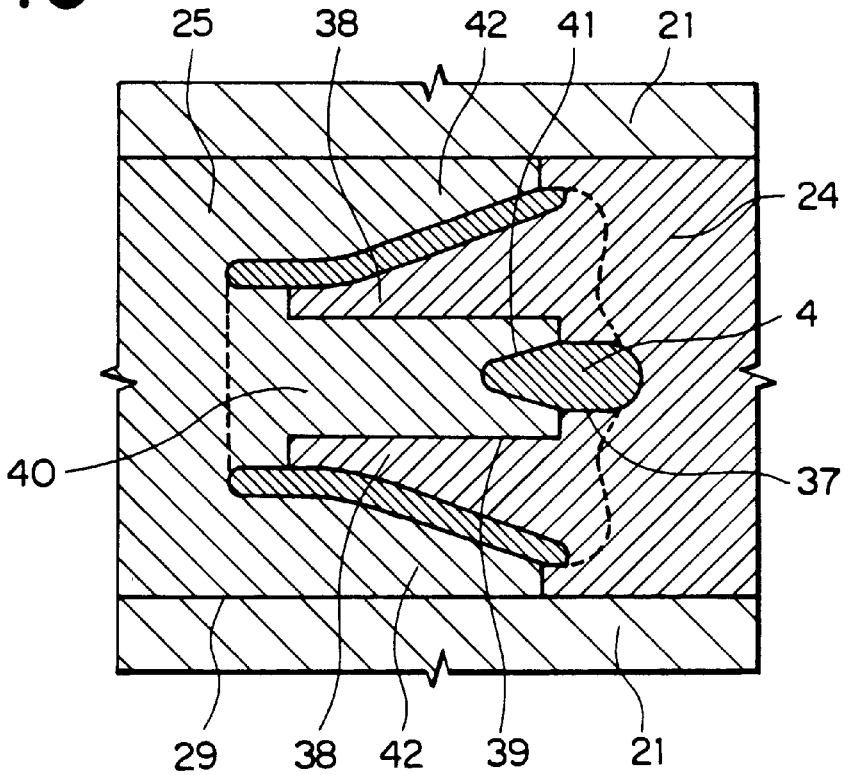
FIG. 10 is a cross-sectional view taken along line B—B of FIG. 8.
Figure 11:
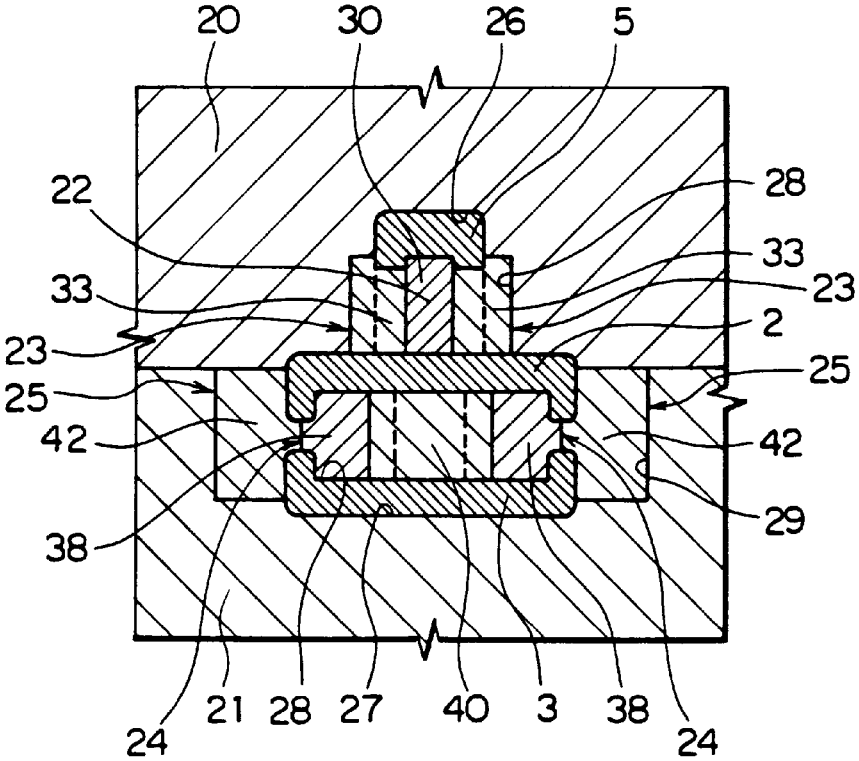
FIG. 11 is a cross-sectional view taken along line C—C of FIG. 8.

As shown in FIG. 11, the upper die 20 has a first cavity 26 for forming part of the upper surface of the upper wing 2, i.e. the upper surface of the slider body 1, and the upper surface of the pull-tab attaching lug 5, the first cavity 26 including a first groove 28 slidably receptive of the first and second slide cores 22, 23 as shown in FIG. 9. And the lower die 21 has a second cavity 27 for forming the lower surface of the lower wing 3, i.e. the bottom surface of the slider body 1, the second cavity 27 including a second groove 29 slidably receptive of the third and fourth slide cores 24, 25 as shown in FIG. 10. The lower die 21 is fixed and the upper die is vertically movable toward and away from the lower die 21. Alternatively, they may be arranged oppositely.

The first and second slide cores 22, 23 slidable in along the first groove 28 of the upper die 21 for forming the cantilevered pull-tab attaching lug 5 standing on the slider body 1 are each in the form of a bar square in transverse cross section having a thickness smaller than the height of the pull-tab attaching lug 5, with their inner end being engageable, as shown in FIG. 9, and the first slide core 22 has at its inner end a central projection 30 for forming the hollow 12, which extends through the base of the pull-tab attaching lug 5, and a pair of side projections 31, 31 disposed and spaced one on each side of the central projection 30 for forming side walls 13 of the hollow 12, generally forming a fork-like shape.

The second slide core 23 is engageable with the first slide core 22 to mold the pull-tab attaching lug 5 and has at its inner end a socket hole 32 receptive of the central projection 30 of the first slide core 22 centrally of a core body thereof, and a pair of tongues 33 slidably engageable with the side projections 31 for forming part of the side walls 13 of the base of the pull-tab attaching lug 5, as shown in FIG. 9. A pair of inwardly bulging protuberances 34 each having an inverted D-shaped transverse cross section are disposed on confronting inner surfaces of the tongues 33, and a stepped cutout 35 is disposed at a common base of the protuberances 34 and is engageable with the central projection 30 for forming the downwardly projecting end projection 14 at the distal end of the pull-tab attaching lug 5.

Further, as shown in FIG. 8, the second slide core 23 has longitudinally on a lower surface of its core body a central ledge 36 projecting from the end surface of the stepped cutout 35, having an arcuate transverse cross section and a width substantially equal to the distance between the protuberances 34 and extending to an intermediate position of the protuberances 34. A distal end of the central ledge 36 is adapted to be disposed underneath and in contact with a lower surface of the central projection 30 of the first slide core 22 for forming the recess 16 in the upper surface of the upper wing 2. Provision of the central ledge 36 in the second slide core 23 is arbitrary.

As shown in FIG. 10, the third slide core 24 slidable in and along the second groove 29 of the lower die 21 for forming the front part of the guide post 4 of the slider body 1 and the interiors of the guide flanges 7 of the upper and lower wings 2, 3 as well as the guide channel 8 has at its inner end centrally of a core body thereof a U-shaped central cutout 37 for forming the front part of the guide post 4 and a pair of lateral projections 38 one on each side of the central cutout 37, the lateral projections 38 having outer surfaces converging toward the rear end 11 of the slider body 1 for forming the interiors of the guide flanges 7 and the guide channel 8. The two lateral projections 38 jointly define an inner recess 39 for a purpose described below.

On the other hand, the fourth slide core 25 complementary to the third slide core 24 has at its inner end centrally of the core body thereof a central plug projection 40 and a V-shaped end cutout 41 in the inner end surface of the central plug projection 40 for forming rear part of the guide post 4 the guide channel 8 and the exteriors of the guide flanges 7. The fourth slide core 25 forms the guide channel 8 when inserted into the inner recess 39 of the third slide core 24.

The fourth slide core 25 has a pair of outer side projections 42 whose inner surfaces converge toward its distal end for engagement with opposite side ends of the third slide core 24 to form the exteriors of the guide flanges 7 of the upper and lower wings 2, 3. Thus parts for guiding the fastener elements in the slider body 1 are formed.

Figure 12:
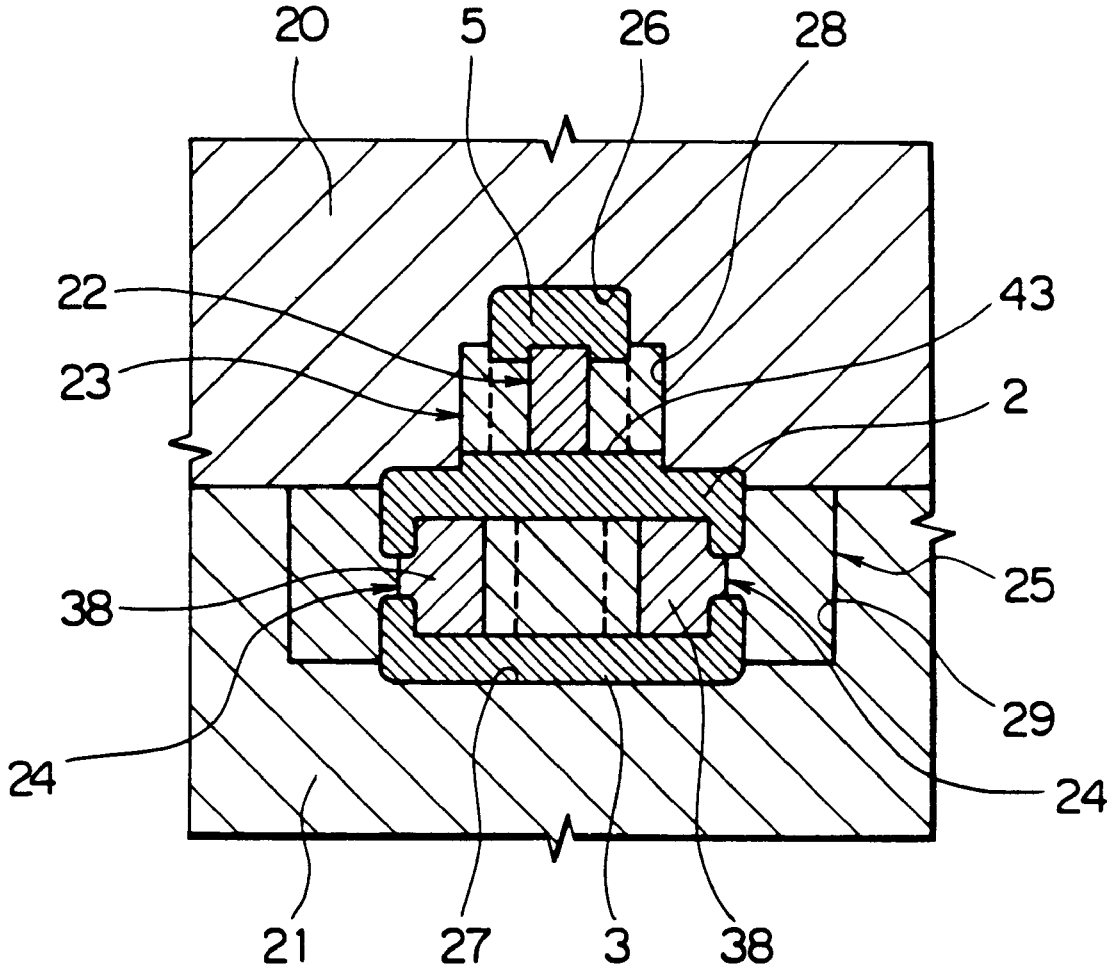
FIG. 12 is a transverse cross-sectional view of a modified mold for die-casting a slide fastener slider.

Finally FIG. 12 shows a modified mold to be used for die-casting the platform 19 on the upper surface of the upper wing 2 of the slider body 1 of FIG. 6. The modified mold is different from the previous mold in that the upper die 20 has in the cavity 26 the groove 28 for slidably receiving the first and second slide cores 22, 23 in such a manner that a lower common surface 43 of the first and second slide cores 22, 23 are upwardly offset from a lower surface of the upper die 20 for forming the stepped platform 19 on the upper wing 2 of the slider body 1. Possible parting lines between the upper mold 20 and the first and second slide cores 22, 23 are aligned with the ridges of the platform 19, it is possible to make the parting lines not eye-catching but neat in appearance.

Further, in the foregoing embodiments, the slide cores 22, 23, 24, 25 are manufactured individually so as to be movable independently of one another. Alternatively the first and third slide cores 22, 24 to be moved in a common direction may be combined in a unified slide core, and likewise the second and fourth slide cores 23, 25 to be moved in a common direction may be combined in a unified slide core.

The features of the slide fastener sliders and the die-casting mold of the present invention are as described above and have the following advantageous results:

According to the first aspect of the invention, since, in a slider in which the upper and lower wings 2, 3 are connected by the guide post 4, a cantilevered pull-tab attaching lug 5 standing on the upper wing 2 of the slider body 1 has a longitudinal hollow 12 through its base, and the pull-tab attaching lug 5 has in the lower surface of its rear end the downwardly directed end projection 14 spaced from the upper wing 2 by the gap 15 and having the width equal to that of the hollow 12, it is possible to provide a slider having the cantilevered pull-tab attaching lug 5 of a unique design as compared to the conventional slider and to attach the pull tab 17 to the pull-tab attaching lug 5 simply as well as to finish the slider neatly without making any parting line on the surfaces of the slider body, particularly in its central portion.

According to the second aspect of the invention, since the hollow 12 extending through the base of the pull-tab attaching lug 5 has the right-angled hexahedral contour and has the pair of vertical side walls 13 on opposite sides of the hollow 12, the base of the cantilevered pull-tab attaching lug 5 can be plastically deformed with ease by a small pressing force to facilitate attaching the pull tab 17 to the pull-tab attaching lug 5.

According to the third aspect of the invention, since the hollow 12 extending through the base of the pull-tab attaching lug 5 extends from the base to the base of the end projection 14 provided in the lower surface of the rear end, the cantilevered pull-tab attaching lug 5 can be plastically deformed with ease to facilitate molding process of the pull-tab attaching lug 5.

According to the fourth aspect of the invention, since the gap 15 between the upper wing 2 and the end projection 14 of the pull-tab attaching lug 5 has a size substantially equal to the thickness of the attachment ring 18 of the pull tab 17, it is possible to restrict the extent of plastic deformation of the pull-tab attaching lug 5 to a minimum.

According to the fifth aspect of the invention, since the upper wing 2 has in its upper surface the recess 16 extending from the rear end 11 forwardly beyond a position underneath the end projection 14 and having the arcuate transverse cross section and having a width larger than the width of the end projection 14, the attachment ring 18 of the pull tab 17 can be threaded onto the pull-tab attaching lug 5 smoothly.

According to the sixth aspect of the invention, since the arcuate recess 16 having the contour substantially complementary to a part of the contour of the outer surface of the attachment ring 18 of the pull tab 17 as viewed from the rear end 11 of the upper wing 2, it is possible to smoothly thread the attachment ring 18 of the pull tab 17 onto the pull-tab attaching lug 5 and to prevent the pull tab 17 from being accidentally removed off the pull-tab attaching lug 5 once threaded, and the pull tab 17 is completely prevented from being removed by a small extent of plastic deformation after the threading.

According to the seventh aspect of the invention, since the pull-tab attaching lug 5 are tapered, with its contour in plan view decreasing gradually from an upper end of the base toward the rear end 11, it is possible to finish the slider in a unique design with an excellent-contour pull-tab attaching lug 5 and to smoothly attach the pull tab 17 to the pull-tab attaching lug 5.

According to the eighth aspect of the invention, since the upper wing 2 has on its upper surface the central platform 19 extending longitudinally between the front and rear ends at opposite sides of the base of the pull-tab attaching lug 5, parting lines due to die-casting on the surface of the slider body 1 are concealed and the slider is finished in a unique design.

According to the ninth aspect of the invention, since the pull tab 17 is attached to the pull-tab attaching lug 5 by threading the attachment ring 18 onto the pull-tab attaching lug 5 via the gap 15 between the upper wing 2 and the end projection 14 and then plastically deforming the pull-tab attaching lug 5 so as to reduce the size of the gap 15, the pull tab 17 can be attached to the pull-tab attaching lug 5 of the slider body 1 in a simple manner using simple means to complete the assembling of the slider.

According to the tenth aspect of the invention, since the mold comprises the upper die 20 having the first cavity 26 for forming the upper surface of the upper wing 2 of the slider body 1 and the upper surface of the cantilevered pull-tab attaching lug 5, the lower die 21 having the second cavity 27 for forming the lower surface of the lower wing 3 and relatively movable toward and away from the upper die 20, a plug-shaped first slide core 22 slidably disposed between the upper and lower dies 20, 21 for forming the hollow 12, which extends through the base of the pull-tab attaching lug 5, and a front and side walls of the base of the pull-tab attaching lug 5, and a recess-shaped second slide core 23 relatively slidable toward and away from the plug-shaped first slide core 22 for forming the end projection 14 of the pull-tab attaching lug 5 and a lower surface of the pull-tab attaching lug, the slider of a neat, unique design in which no parting lines appear on the surface of the slider body 1 and the pull-tab attaching lug 5 which is easy to be plastically deformed can be molded simply and easily.

Further, by providing the recess-shaped third slide core 24 slidably engageable with the first and second slide cores 22, 23 and the upper die 20 and slidable on the lower die 21 for forming the front part of the guide post 4 and interiors of the guide groove 8 and of guide flanges 7, and the plug-shaped fourth slide core 25 slidable toward and away from the third slide core 24 for forming the rear part of the guide post 4 and exteriors of the guide groove 8 and the guide flanges 7, the third and fourth slide cores 24, 25 being slidable, it is possible to die-cast the fastener-element guide parts, which constitute the main parts of the slider, easily and precisely in cooperation with the mold members for forming the pull-tab attaching lug 5.

According to the eleventh aspect of the invention, since the first slide core 22 has a long, central projection 30 extending centrally thereof for forming the hollow 12, and a pair of short, side projections 31 extending and spaced laterally in opposite sides of the central projection for forming the side walls 13, and the second slide core 23 has the pair of inwardly directed protuberances 34 on opposite sides of the core body for slidably engageable with the central projections 30 to form the lower surface of the pull-tab attaching lug 5, and the stepped cutout 35 disposed at a common base of the protuberances 34 and engageable with the central projection 30 for forming the end projection 14 of the pull-tab attaching lug 5, it is possible to mold the pull-tab attaching lug 5 which can be plastically deformed by a small pressing force using the molding members of the simple structure.

According to the twelfth aspect of the invention, since the second slide core 23 has longitudinally on its lower surface the central ledge 36 having the arcuate transverse cross section and the width substantially equal to the width of the pull-tab attaching lug 5 and extending to an intermediate position of the protuberances 34, the distal end of the central ledge 36 being adapted to be disposed underneath and in contact with the lower surface of the central projection 30 of the first slide core 22, it is possible to die-cast the slider body 1 such that the attachment ring 18 of the pull tab 17 can be threaded onto the pull-tab attaching lug 5 with ease.

According to the thirteenth aspect of the invention, since the upper die 20 has in the cavity 26 the groove 28 for slidably receiving the first and second slide cores 22, 23 in such a manner that the lower common surface 43 of the first and second slide cores 22, 23 are upwardly offset from the lower surface of the upper die 2 for forming the stepped platform 19 on the upper wing 2, it is possible to die-cast the slider body simply in a unique design without any parting line on the upper surface of the slider body 1 using simple molding members.

What is claimed is:

1. A slide fastener slider comprising:

(a) a die-cast slider body composed of upper and lower wings connected at their front ends by a guide post;

(b) a cantilevered pull-tab attaching lug projecting from an upper surface of said guide post toward an open rear end of said upper wing; and (c) a pull tab having an attachment ring threaded on said pull-tab attaching lug;

wherein said pull-tab attaching lug has a hollow extending longitudinally through its deformable base and an end projection extending from a rear end of said pull-tab attaching lug toward and terminating short of an upper surface of said upper wing, said end projection having a width substantially equal to a width of said hollow and being spaced a gap from said upper wing.

2. A slide fastener slider according to claim 1, wherein said hollow extending through the base of said pull-tab attaching lug has a right-angled hexahedral contour and has a pair of vertical flat side walls.

3. A slide fastener slider according to claim 1, wherein said hollow extending through said base of said pull-tab attaching lug extends from said base to a base of said end projection projecting from a lower surface of a distal end of said pull-tab attaching lug.

4. A slide fastener slider according to claim 1, wherein said gap between said upper wing and said end projection of the pull-tab attaching lug has a size substantially equal to the thickness of said attachment ring of said pull tab.

5. A slide fastener slider according to claim 1, wherein said upper wing has in its upper surface a recess extending from said rear end forwardly beyond a position underneath said end projection, said recess having an arcuate transverse cross section and a width larger than the width of said end projection.

6. A slide fastener slider according to claim 5, wherein said recess of arcuate cross section has a contour substantially complementary to a part of a contour of the outer surface of said attachment ring of said pull tab as viewed from said rear end of said upper wing.

7. A slide fastener slider according to claim 1, wherein said pull-tab attaching lug is tapered, as viewed in plan view, from an upper end of the base toward said rear end.

8. A slide fastener slider according to claim 1, wherein said upper wing has on its upper surface at opposite sides of the base of the pull-tab attaching lug a central platform bulging centrally of the slider body and extending longitudinally between said front and rear ends.

9. A slide fastener slider according to claim 1, wherein said pull tab is attached to said pull-tab attaching lug by threading said attachment ring onto said pull-tab attaching lug via said gap between said upper wing and said end projection and then plastically deforming said pull-tab attaching lug so as to reduce the size of said gap.

10. A slide fastener slider according to claim 1, wherein the hollow extends from a front side of the pull-tab attaching lug through the base of the pull-tab attaching lug toward the end projection of the pull-tab attaching lug.

11. A slide fastener slider comprising:

(a) a die-cast slider body composed of upper and lower wings connected at their front ends by a guide post;

(b) a cantilevered pull-tab attaching lug projecting from an upper surface of said guide post toward an open rear end of said upper wing; and (c) a pull tab having an attachment ring threaded on said pull-tab attaching lug;

wherein said pull-tab attaching lug has a hollow extending longitudinally through its deformable base and an end projection extending from a rear end of said pull-tab attaching lug toward and terminating short of an upper surface of said upper wing, said end projection having a width substantially equal to a width of said hollow and being spaced a gap from said upper wing;

wherein said upper wing has on its upper surface at opposite sides of the base of the pull-tab attaching lug a central platform bulging centrally of the slider body and extending longitudinally between said front end rear ends.

* * * * *